US010024120B2

(12) United States Patent
Persent et al.

(10) Patent No.: US 10,024,120 B2
(45) Date of Patent: Jul. 17, 2018

(54) RISER PIPE SECTION EQUIPPED WITH A LOCKING RING ARRANGED BETWEEN THE MAIN TUBE AND THE AUXILIARY LINE

(71) Applicant: IFP Energies nouvelles, Rueil-Malmaison (FR)

(72) Inventors: Emmanuel Persent, Croissy sur Seine (FR); Navid Saeedi, Alfortville (FR); Gerard Papon, Les Essarts le Roi (FR); Eleonore Roguet, Rueil-Malmaison (FR)

(73) Assignee: IFP Energies nouvelles, Rueil-Malmaison (FR)

( * ) Notice: Subject to any disclaimer, the term of this patent is extended or adjusted under 35 U.S.C. 154(b) by 0 days.

(21) Appl. No.: 15/309,066

(22) PCT Filed: Apr. 16, 2015

(86) PCT No.: PCT/EP2015/058270
§ 371 (c)(1),
(2) Date: Nov. 4, 2016

(87) PCT Pub. No.: WO2015/169560
PCT Pub. Date: Nov. 12, 2015

(65) Prior Publication Data

US 2017/0074052 A1 Mar. 16, 2017

(30) Foreign Application Priority Data

May 5, 2014 (FR) ..... 14 54057

(51) Int. Cl.
*E21B 17/08* (2006.01)
*E21B 17/01* (2006.01)
(Continued)

(52) U.S. Cl.
CPC ..... *E21B 17/085* (2013.01); *E21B 17/01* (2013.01); *E21B 17/046* (2013.01); *E21B 17/18* (2013.01)

(58) Field of Classification Search
CPC ..... E21B 17/085; E21B 17/01; E21B 17/046; E21B 17/18
(Continued)

(56) References Cited

U.S. PATENT DOCUMENTS 4,280,719 A 7/1981 Daniel et al.
4,491,346 A 1/1985 Walker
(Continued)

FOREIGN PATENT DOCUMENTS

FR 2432672 A1 2/1980
FR 2526517 A2 11/1983
(Continued)

OTHER PUBLICATIONS

International Search Report for PCT/EP2015/058270 dated Jul. 7, 2015; English translation submitted herewith (7 Pages).

*Primary Examiner* — Matthew R Buck
*Assistant Examiner* — Patrick F Lambe
(74) *Attorney, Agent, or Firm* — Fitch, Even, Tabin & Flannery, L.L.P.

(57) ABSTRACT

The present invention relates to a riser section (4) equipped with an external locking ring (11). Locking ring (11) cooperates with a male connector element (9) and a female connector element (8) by means of a series of studs. The invention also relates to a riser consisting of several sections (4) and to the use of the riser for carrying out an offshore drilling operation.

22 Claims, 10 Drawing Sheets

(51) Int. Cl.
*E21B 17/046* (2006.01)
*E21B 17/18* (2006.01)

(58) Field of Classification Search
USPC ..... 166/367
See application file for complete search history.

(56) References Cited

U.S. PATENT DOCUMENTS

| | | | | |
|---|---|---|---|---|
| 2003/0205380 | A1 | 11/2003 | Guesnon et al. | |
| 2005/0206163 | A1 | 9/2005 | Guesnon et al. | |
| 2010/0319925 | A1 | 12/2010 | Papon et al. | |
| 2011/0203804 | A1 | 8/2011 | Guesnon et al. | |
| 2011/0209878 | A1* | 9/2011 | Guesnon ..... | E21B 17/01 166/367 |
| 2013/0020087 | A1 | 1/2013 | Guesnon et al. | |

FOREIGN PATENT DOCUMENTS

| | | | |
|---|---|---|---|
| FR | 2839339 | A1 | 11/2003 |
| FR | 2866942 | A1 | 9/2005 |
| FR | 2925105 | A1 | 6/2009 |
| FR | 2956693 | A1 | 8/2011 |
| FR | 2956694 | A1 | 8/2011 |
| WO | WO 2011/104629 | A1 | 9/2011 |
| WO | 2015/071411 | A2 | 5/2015 |

* cited by examiner

RISER PIPE SECTION EQUIPPED WITH A LOCKING RING ARRANGED BETWEEN THE MAIN TUBE AND THE AUXILIARY LINE

CROSS-REFERENCE TO RELATED APPLICATIONS

This application is a U.S. national phase application filed under 35 U.S.C. § 371 of International Application No. PCT/EP2015/058270, filed Apr. 16, 2015, designating the United States, which claims priority from French Patent Application No. 14/54.057, filed May 5, 2014, which are hereby incorporated herein by reference in their entirety for all purposes.

FIELD OF THE INVENTION

The present invention relates to the field of very deep sea oil reservoir drilling and development. It concerns a riser pipe section.

BACKGROUND OF THE INVENTION

A riser is made up of an assembly of tubular elements of length ranging between 15 and 27 m (50 and 90 feet), assembled by connectors. The tubular elements generally consist of a main tube provided with connectors at each end. Tubular auxiliary lines, also called peripheral lines, commonly referred to as "kill line", "choke line", "booster line" and "hydraulic line", allowing circulation of technical fluids, are provided parallel to the main tube. The tubular elements are assembled on the drilling site, from a floater. The riser is lowered into the water depth as the tubular elements are assembled, until it reaches the wellhead located on the sea bottom.

In the perspective of drilling at water depths that can reach 3500 m or more, the weight of the riser becomes very penalizing. This phenomenon is increased by the fact that, for the same maximum working pressure, the length of the riser requires a larger inside diameter for the auxiliary lines, considering the necessity to limit pressure drops.

Besides, the necessity to decrease the riser assembly time is all the more critical since the water depth, and therefore the riser length, is great.

Documents FR-2,925,105, FR-2,956,693 and FR-2,956,694 describe various solutions notably aiming to involve the auxiliary lines, together with the main tube, in the taking up of the longitudinal stresses applied to the riser. However, for the systems described in these patents, fastening of the auxiliary lines with respect to the main tube leads to high tensile stresses in the auxiliary lines. In order to withstand these tensile stresses, the auxiliary lines have great thickness values, which generates an increase in the mass and size of the floats, and therefore in the cost of the riser. Furthermore, the connectors provided in these patents are not entirely dismountable, which makes inspection and maintenance of the riser difficult.

The present invention describes a solution providing a compact connector design with a locking ring arranged between the main tube and the auxiliary lines. The connector according to the invention is well suited for deep-sea risers, i.e. located at depths greater than 2000 meters. Furthermore, the connector according to the invention is dismountable, and problems of auxiliary line connection interference are limited.

SUMMARY OF THE INVENTION

The invention relates to a riser section comprising a main tube element extended by a male connector element and by a female connector element, wherein a locking ring is mounted on said male connector element, and wherein said riser section additionally comprises at least one auxiliary line element, said male and female connector elements extending the main tube element by increasing the section and the thickness of said main tube element so as to form flanges for passage of said auxiliary line element. Said locking ring is arranged between said main tube element and said auxiliary line element, the inner surface of said locking ring comprises a first series of studs, the outer surface of said female connector element comprises a second series of studs, said male connector element comprises a third series of studs on the outer face thereof and the inner surface of said locking ring comprises a fourth series of studs suited to cooperate with said third series of studs.

According to one embodiment of the invention, at least one stud of the third and fourth series of studs protrudes over an angle range distinct from the angle range of the studs of the first and second series of studs.

Advantageously, each row of the first and second series of studs comprises a number of studs distinct from the number of studs of each row of the third and fourth series of studs.

Preferably, the first and second series of studs comprise at least one row of four studs, and the third and fourth series of studs comprise at least one row of three studs.

According to an embodiment of the invention, the first and second series of studs comprise a number of rows distinct from the number of rows of the third and fourth series of studs.

Advantageously, the first and second series of studs comprise two rows of studs, and the third and fourth series of studs comprise one row of studs.

According to the invention, each series of studs consists of at least two rows of at least four studs.

Advantageously, a sleeve is secured within said male connector element, said sleeve being suited to cooperate with the female connector element so as to form a sealed link.

According to an embodiment of the invention, said riser section comprises a locking collar cooperating with the peripheral surfaces of said flanges for assembling said flanges.

Preferably, the inner face of said locking collar is provided with a first series of studs and the peripheral surface of the flange of said female connector element comprises a second series of studs.

According to a variant embodiment of the invention, the inner face of said locking collar is provided with a third series of studs and the peripheral surface of the flange of said male connector element comprises a fourth series of studs suited to cooperate with said third series of studs.

According to one aspect of the invention, said auxiliary line element is a hooped steel tube with reinforcement wires such as glass, carbon or aramid fibers, coated with a polymer matrix.

According to a variant embodiment of the invention, said auxiliary tube element is secured to the two flanges of said male and female connector elements.

Alternatively, said auxiliary tube element is secured to a flange of said male and female connector elements and it is connected by a sliding pivot connection to the other flange of said male and female connector elements, said sliding pivot connection allowing a relative translational motion between said main tube element and said auxiliary line element over a distance limited by a clearance adjustment means arranged on said auxiliary line element.

Advantageously, said clearance adjustment means consists of a nut or a threaded part.

According to a first aspect, said auxiliary line element is extended on the one hand by a female end piece and on the other hand by a male end piece provided with a nut.

According to a second aspect, said auxiliary line element is extended on the one hand by a female end piece and on the other hand by a receptacle in which a male pin provided with a stop is inserted.

According to a third aspect, said auxiliary line element is extended on the one hand by a receptacle in which a female pin is inserted and on the other hand by a receptacle in which a male threaded pin is screwed, said male threaded pin comprising a shoulder.

Preferably, said distance limited by said clearance adjustment means ranges between 0 mm and 31.75 mm, preferably between 2.54 mm and 25.4 mm.

Furthermore, the invention relates to a riser pipe comprising at least two riser sections according to the invention, for which the connection between two consecutive sections is achieved by means of said male and female connector elements and of said locking ring.

Advantageously, said distance of the relative translational motion of said sliding pivot connection is adjusted so as to be positive upon connection of at least two sections of said riser and to be zero while using said riser.

The invention also relates to the use of a riser according to the invention for carrying out an offshore drilling operation.

BRIEF DESCRIPTION OF THE FIGURES

Other features and advantages of the method according to the invention will be clear from reading the description hereafter of embodiments given by way of non limitative example, with reference to the accompanying figures wherein.

DETAILED DESCRIPTION OF THE INVENTION

Figure 1:
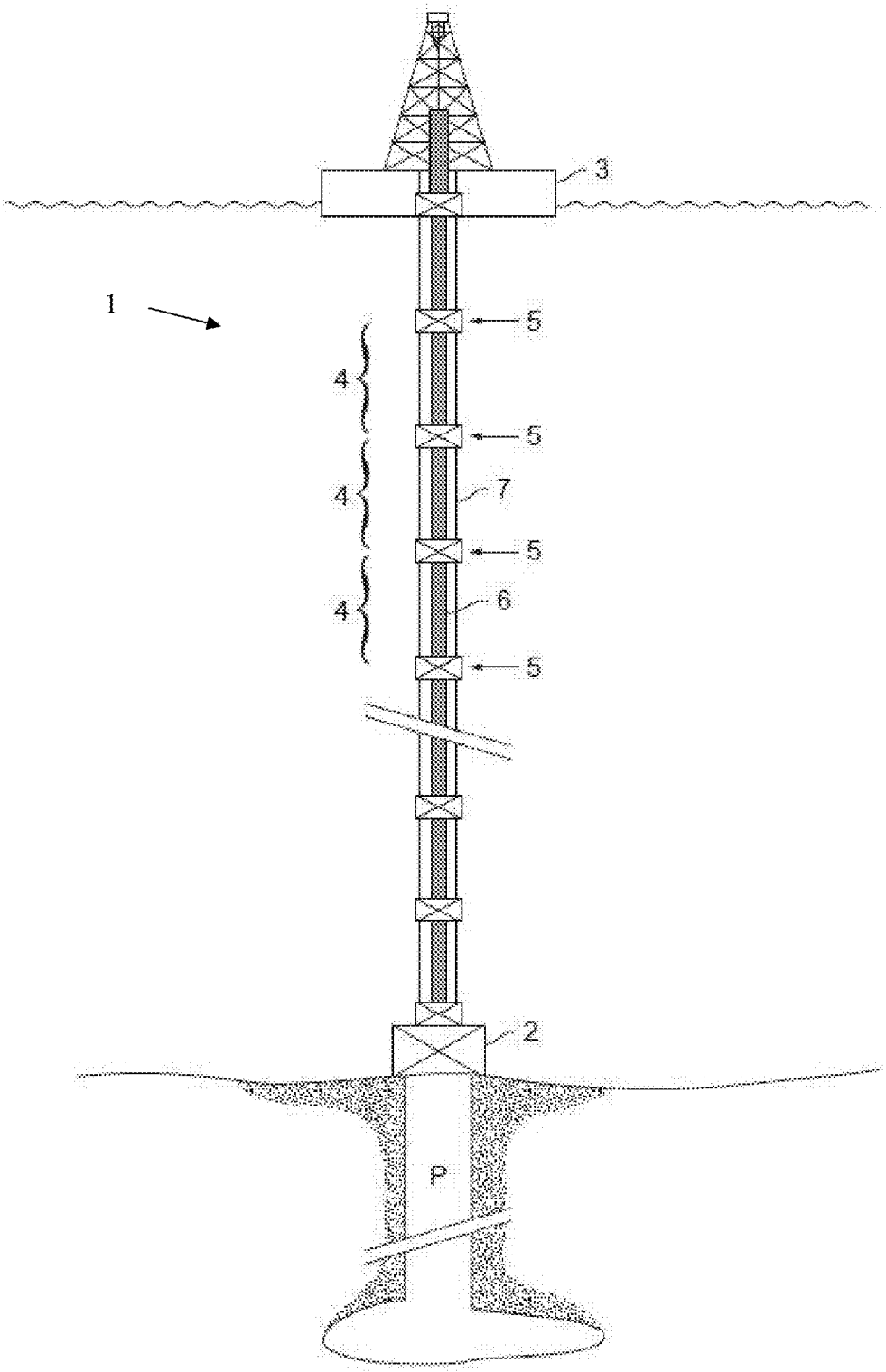
FIG. 1 diagrammatically shows a riser according to the invention.

FIG. 1 diagrammatically shows an offshore riser pipe 1. Riser 1 extends well P and it stretches from wellhead 2 to a floater 3, a platform or a vessel for example. Wellhead 2 is provided with a preventer commonly referred to as B.O.P. or Blow-Out Preventer. Riser 1 is made up of an assembly of several sections 4 assembled end to end by connectors 5. Each section consists of a main tube element 6 provided with at least one auxiliary line element 7, also referred to as peripheral line. Auxiliary lines referred to as kill lines or choke lines are used to provide well safety during control procedures relative to the inflow of fluids under pressure in the well. The line referred to as choke line is a safety line carrying fluids (oil, water, gas) coming from the well in the event of an inflow and driving them towards the choke manifold and the flare. The line referred to as kill line is a safety line enabling injection into the well of heavy fluids and cements allowing an otherwise uncontrollable blowout to be stopped. The auxiliary line referred to as booster line allows mud to be injected into the well in order to increase the annulus velocity thereof and to prevent sedimentation of the cuttings; it is also used for replacing the mud contained in the riser by water prior to disconnection. The line referred to as hydraulic line allows the wellhead preventer to be controlled. Hydraulic lines allow the BOP safety devices (valves and accumulators) to be supplied with hydraulic fluid (glycol-laden distilled water) under pressure.

Figure 2:
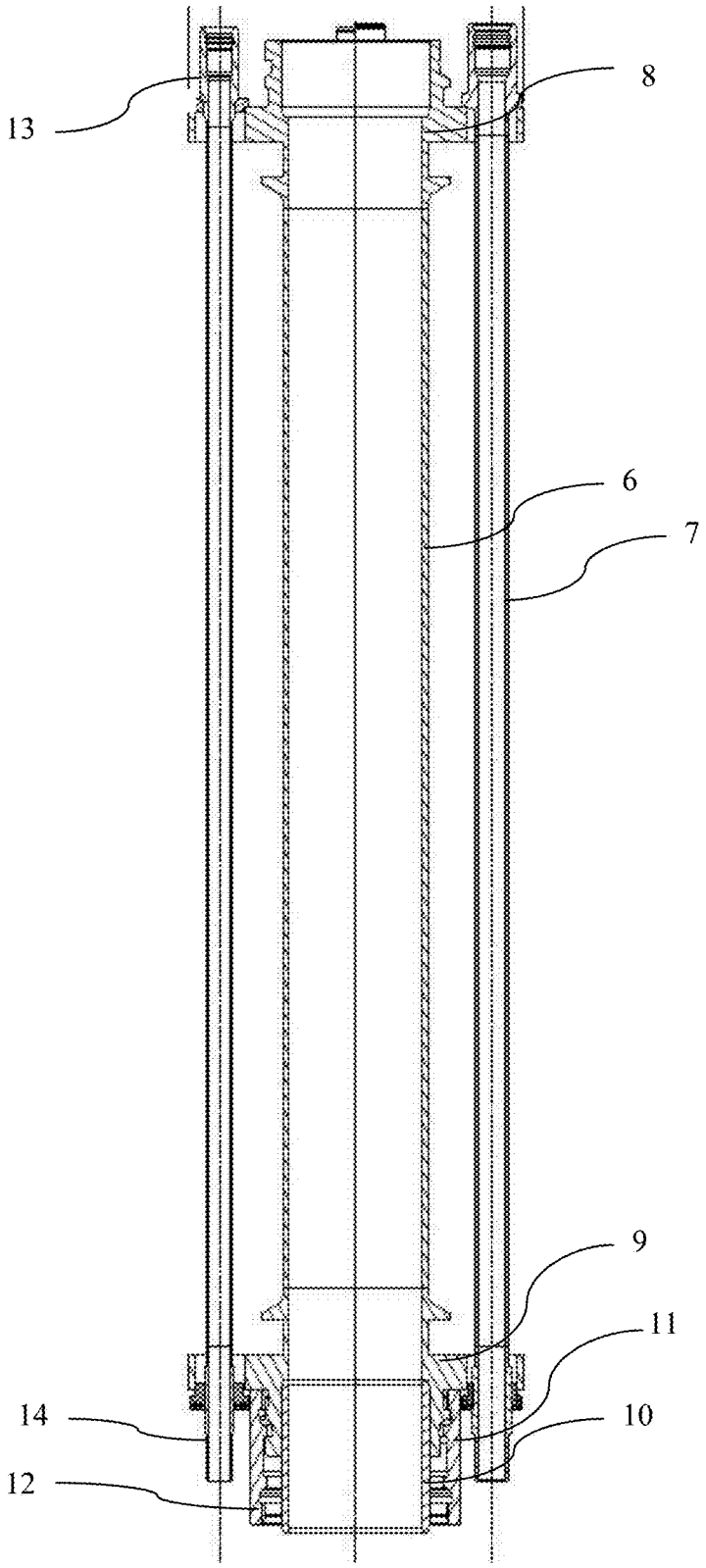
FIG. 2 illustrates a riser section according to an embodiment of the invention.

FIG. 2 diagrammatically shows a section 4 of the riser according to one embodiment of the invention. Section 4 comprises a main tube element 6 whose axis forms the axis of the riser. Auxiliary lines 7 make up auxiliary lines or ducts arranged parallel to the axis of the main tube. The elements of auxiliary line 7 have lengths substantially equal to the length of main tube element 6, generally ranging between 10 and 30 meters. There is at least one line 7 arranged on the periphery of the main tube. In FIG. 2, two lines 7 are shown.

A connector 5 shown in FIG. 1 consists of two elements designated, in reference to FIG. 2, by female connector element 8 and male connector element 9. Connector elements 8 and 9 are mounted at the ends of main tube element 6. Female connector element 8 is secured to tube 6, for example by welding, by screwing, by crimping or by clamping linkage. Male connector element 9 is secured to tube 6, for example by welding, by screwing, by crimping or by clamping linkage. The assembly of male connector element 9 with a female connector element 8 of another section forms connector 5 that transmits stresses from one riser section to the next section, notably the longitudinal stresses undergone by the riser.

Connector 5 can be designed and dimensioned so as to meet the specifications mentioned by the API 16 R and API 2 RD standards edited by the American Petroleum Institute.

Figure 3:
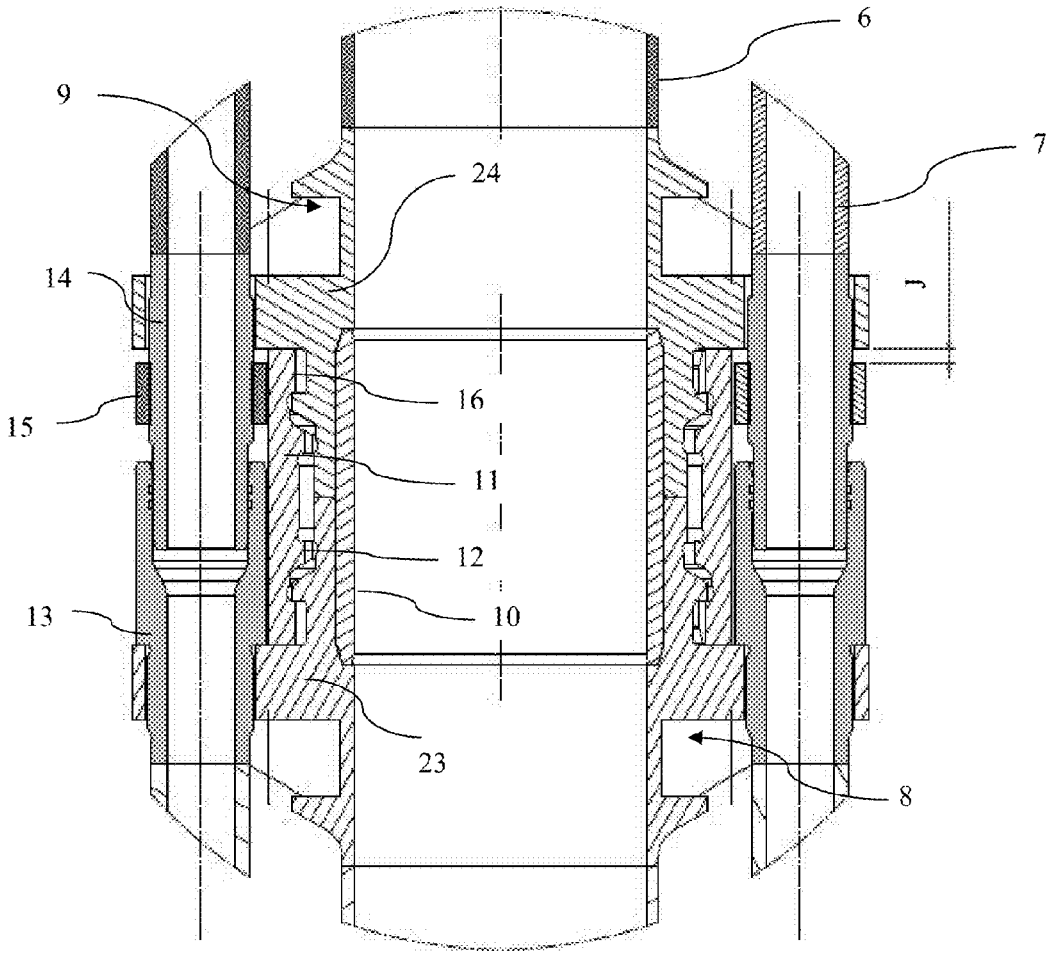
FIG. 3 illustrates the connection of two riser sections according to a first embodiment of the invention.

FIG. 3 shows a male connector element 9 that is fitted in a female connector element 8. A portion of male connector element 9 penetrates inside female connector element 8. This fitting is limited by an axial stop: the end of male connector element 9 comes to rest against the axial shoulder provided on the inner surface of female connector element 8: the axial shoulder provided on the outer surface of male connector element 9 comes to rest against the axial shoulder provided on the inner surface of female connector element 8. As shown in FIGS. 2 and 3, male connector element 9 can comprise a sleeve 10 fastened in the male connector element. Sleeve 10 fulfils a centering and sealing function with respect to the male 9 and female 8 connector elements. Fastening of sleeve 10 can be achieved by welding, by threading, by glueing, by hooping or by any other similar means. Instead of sleeve 10, variant embodiments (not shown) can be considered, such as an extension of main tube element 6 at the male connector element.

Connector 5 comprises a locking ring 11 that is mounted on male connector element 9 and positioned between main tube element 6 and auxiliary line element 7: locking ring 11 is positioned on the outer surface of the male 9 and female 8 connector elements, and auxiliary line element 7 is arranged outside locking ring 11. In other words, the distance between the axis of auxiliary line element 7 and the axis of main tube element 6 is greater than the sum of the outside radius of locking ring 11 and of the radius of auxiliary line element 7. The diameter of ring 11 is smaller than the peripheral diameter (the largest diameter) of the male 9 and female 8 connector elements. When male connector element 9 is fitted in a female connector element 8, a part of ring 11 comes into contact with the outer surface of female connector element 8 in such a way that a series of studs 12 provided on the inner surface of ring 11 cooperates with a series of studs provided on the outer face of female connector element 8. Locking and unlocking of connector 5 is achieved through rotation of ring 11 (bayonet type locking). Ring 11 can be provided with operating means, for example an operating bar that can be dismountable. The operating means allow ring 11 to be rotated. The longitudinal stresses, i.e. the stresses oriented along the axis of the main tube, are transmitted from a section 4 to the adjacent section 4 through the agency of the bayonet type connection between ring 11 and female connector element 8. More precisely, the longitudinal stresses are transmitted from studs 12 of ring 11 to the studs of female connector element 8.

Locking ring 11 is mounted on male connector element 9. According to the embodiment illustrated in FIG. 3, locking ring 11 comprises on the inner face thereof another series of studs 16 cooperating with a series of studs positioned on the outer face of male connector element 9. Thus, locking ring 11 is fastened to the male connector element when riser sections are connected. In an unlocked situation, ring 11 is secured to male connector element 9 by pins (not shown in FIG. 3). Furthermore, this embodiment of locking ring 11 allows to have a connector that can be entirely dismounted so as to facilitate inspection and maintenance thereof. This embodiment also allows to have a ring 11 and male 9 and female 8 connector elements that are nearly symmetrical, which facilitates their manufacture.

In reference to FIG. 3, ring 11 is mounted on the outer surface of male connector element 9. It is secured by the series of studs of the ring and the male 9 and female 8 connector elements. Thus, the axial stresses are transmitted from male connector element 9 to female connector element 8 via the studs without going through sleeve 10.

Locking ring 11 is made of a single piece in order to simplify mounting thereof and for higher mechanical strength.

Figure 4:
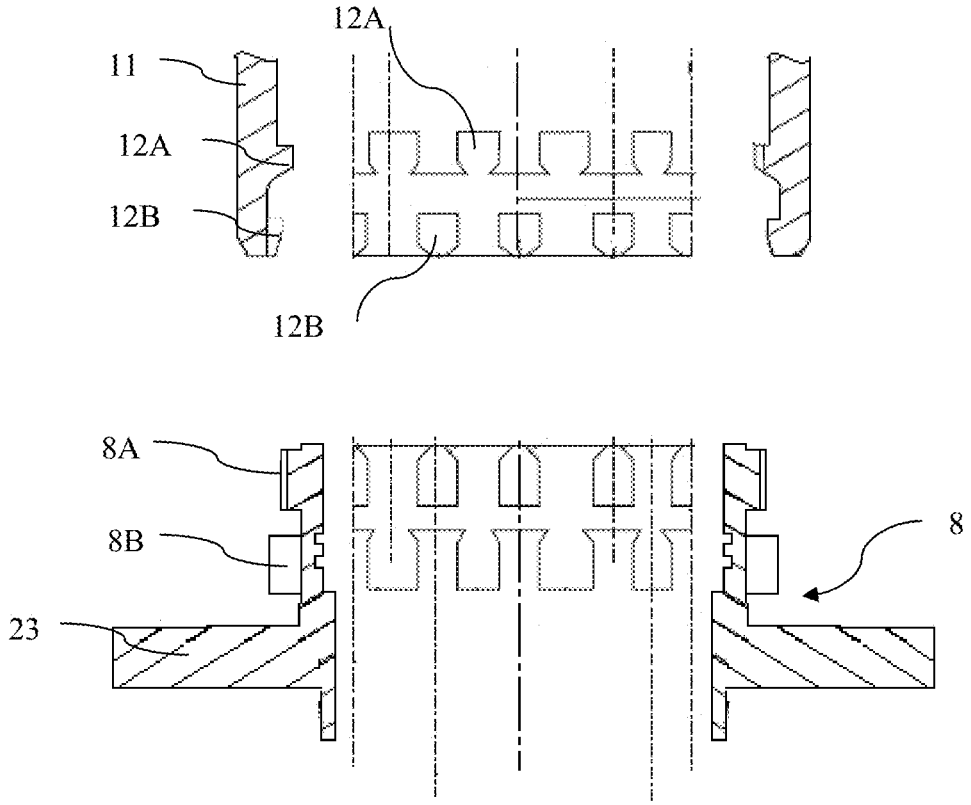
FIG. 4 illustrates an exploded view prior to connection of the locking ring and the female connector element according to a variant embodiment of the invention.

In reference to FIGS. 3 and 4, female connector element 8 and ring 11 respectively comprise a series of studs consisting of two crowns (or rows) of studs or pegs providing axial locking of connector 5. The studs preferably extend in radial directions. According to a preferred embodiment, each crown (row) of studs comprises at least four studs. In FIG. 4, female connector element 8 comprises a first crown 8A of four studs and a second crown 8B of four studs. Ring 11 also comprises a first crown 12A of four studs and a second crown 12B of four studs. FIG. 4 only shows the lower part of ring 11, i.e. only the part connected with female connector element 8.

The studs are angularly offset from one crown to the next and they are inscribed in cylindrical surfaces of different radii. For example, the first and second crowns of ring 11 are respectively inscribed in cylindrical surfaces of radius r and R (with r<R). The first and second crowns of female connector element 8 are respectively inscribed in cylindrical surfaces of radius r' and R' (with C<R'). Radius r is slightly larger than radius R' so that the studs of the second crown of female connector element 8 can slide and rotate freely within the cylinder formed by the inner surface of the studs of the first crown of ring 11.

Studs 12A of the first crown of ring 11 cooperate with studs 8A of the first crown of female connector element 8 so as to form a bayonet assembly. Studs 12B of the second crown of ring 11 cooperate with studs 8B of the second crown of female connector element 8.

More precisely, when female connector element 8 is engaged in ring 11, female connector element 8 follows a translational motion in the direction of the main tube axis according to the following successive stages:

- first crown 8A of female connector element 8 moves into second crown 12B of ring 11, then
- studs 8A of the first crown of female connector element 8 fit between studs 12A of the first crown of ring 11 and, simultaneously, studs 8B of the second crown of female connector element 8 fit between studs 12B of the second crown of ring 11, then
- when ring 11 reaches the stop, studs 12B of the second crown of ring 11 lodge themselves in a groove (schematized in FIGS. 3 and 4) provided in female connector element 8 between first crown 8A and second crown 8B of female connector element 8, and studs 12A of the first crown of ring 11 lodge themselves in a groove (schematized in FIGS. 3 and 4) provided in female connector element 8 beneath first crown 8A of female connector element 8.

Then, when ring 11 abuts against female connector element 8, ring 11 is pivoted in such a way that the studs of ring 11 are positioned opposite the studs of the female connector element. Studs 12A of the first crown of ring 11 are positioned opposite the studs of the first crown of female connector element 8 and studs 12B of the second crown of ring 11 are positioned opposite studs 8B of the second crown of female connector element 8. Thus, the studs of ring 11 abut axially with respect to the studs of female connector element 8 and they block the translational motion of female connector element 8 with respect to male connector element 9.

Each one of the two bayonet assembly systems can allow to ensure, between the studs of female element 8 and the studs of ring 11, a contact over a total angle range that can reach 175°. Preferably, the two assembly systems being angularly offset about the axis of the connector, the connector according to the invention allows the axial stresses to be distributed over approximately 350° about the axis.

Alternatively, according to the invention, ring 11 and female connector element 8 may comprise only one crown each: the studs of the single crown of ring 11 cooperate with the studs of the single crown of female connector element 8.

The number of studs per crown can vary, notably as a function of the inner tube diameters and of the stresses to be transmitted by the connector.

According to the embodiment shown in FIG. 3, the bayonet locking system of ring 11 in male connector element 9 using the series of studs 16 is similar to the bayonet locking system used for ring 11 in female connector element 8:

- male connector element 9 and ring 11 respectively comprise two crowns (or rows) of studs or pegs, allowing axial locking of connector 5 to be ensured, the studs preferably extend in radial directions, the relations between radii r, r', R and R' are also verified so that ring 11 can be inserted in male connector element 9, according to a preferred embodiment, each crown (row) of studs comprises four studs.

Figure 5:
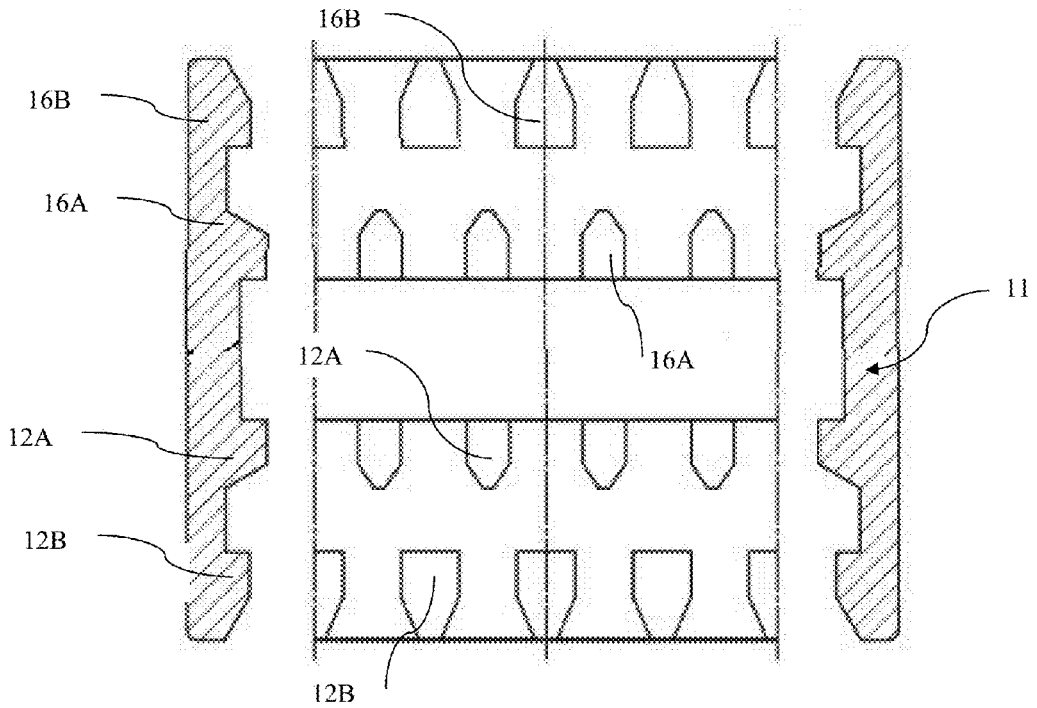
FIG. 5 illustrates a locking ring according to a variant embodiment of the invention.

FIG. 5 shows a ring 11 according to this embodiment. Locking ring 11 comprises a series of studs 12 suited to cooperate with a female connector element 8 so as to form a bayonet assembly and a series of studs 16 suited to cooperate with a male connector element 9 so as to form a bayonet assembly. Each series of studs is made up of two crowns comprising four studs. As described in reference to FIG. 4, the series of studs 12 comprises a first crown 12A and a second crown 12B cooperating with two crowns of female connector element 8. The series of studs 16 comprises a first crown 16A of studs and a second crown 16B of studs. Advantageously, the series of studs 16 is similar to the series of studs 12, and the connection of the series of studs 16 within male connector element 9 is identical to the connection of the series of studs 12 within female connector element 8. Thus, locking ring 11 is substantially symmetrical. With this assembly, the axial stresses are transmitted from male connector element 9 to female connector element 8 via the studs without going through sleeve 10.

In this case, where male connector element 9 comprises a sleeve 10, male connector element 9 can be symmetrical to female connector element 8.

The link connecting ring 11 to male connector element 9 can comprise pins supporting the weight of the ring when the connection is unlocked.

A locking system allows ring 11 to be blocked in rotation.

According to a variant embodiment of the invention, the bayonet assembly on the male connector element side comprises a connection angle range distinct from the connection angle range on the female connector element side, so that the two connections are not simultaneous. Thus, at least one stud, preferably all the studs, of the third and fourth series of studs protrude(s) over an angle range distinct from the angle range of the studs of the first and second series of studs. Thus, the connection angle range of the male element is different from the connection angle range of the female element. It is therefore possible to do without the mounting pins because, when connecting the female connector element, the studs of the male connector element remain in contact in order to provide locking on the female connector side. For example, in the case of an even distribution of the studs over the circumference of the connection means, the bayonet assembly on the male connector element side comprises a number of studs distinct from the bayonet assembly on the female connector element side.

For this variant embodiment, stops can be provided to limit rotations of the ring. For example, the stops can consist of a block secured to the locking ring and arranged on the outer surface of the locking ring, and to protruding pieces of the male flange, against which the block of the ring can come to rest. Three protruding pieces can be achieved: a first one serving as a locking stop, a second serving as a female element unlocking stop and a third serving as a male element unlocking stop (after removing the second stop).

Figure 12:
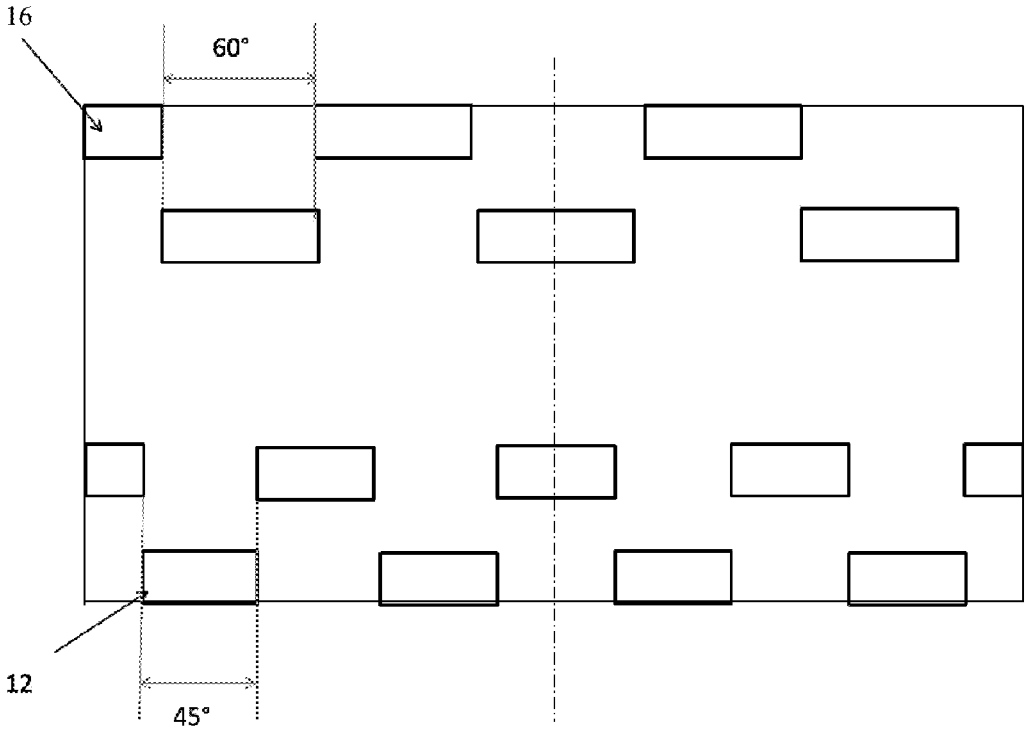
FIG. 12 shows the studs of a locking ring according to a variant embodiment of the invention.

According to an example of this variant embodiment, the first and second series of studs (on the female connector element side) comprise at least one row of four studs and the third and fourth series of studs (on the male connector element side) comprise at least one row of three studs. Preferably, the four studs of the connection with the female connector element extend over an angle range of about 45° and the three studs of the connection with the male connector element extend over an angle range of about 60°. FIG. 12 shows the inner circumference of a locking ring for such a configuration, with a first series of studs 12 made up of two rows of four studs having an angle range of 45°, and the third series of studs 16 made up of two series of three studs having an angle range of 60°. Thus, locking on both sides is achieved over 360°. In unlocked position, the ring rests on the male connector element by three 15° angular sectors. The rotation of the ring by a quarter turn (45°) brings all the rows of studs into coincidence (on the male connector element side and the female connector element side). Dismounting the ring is done by simply performing a first 15° rotation of the ring, by sliding it longitudinally until the first row of studs is released, then by performing a second 60° rotation the other way round and by ending with a longitudinal translation that releases the locking ring from the male connector element on the sleeve side. Alternatively, other angle ranges can be considered: for examples, studs of 15° and 20° respectively, studs of 60° and 90° respectively.

Besides, in combination or not with the variant embodiment described above, the series of studs can all (male connector side and female connector side) comprise the same number of rows of studs, preferably two or more.

Alternatively, the series of studs on the male connector side can comprise a distinct number of rows, preferably less than the number of rows of studs on the female connector side. Thus, the design, mounting and dismounting of the locking ring and of the male connector element are simplified. According to an example, the first and second series of studs (female connector element side) comprise two rows of studs and the third and fourth series of studs (male connector element side) comprise a single row of studs.

For these variant embodiments with a distinct number of studs on either side of the connection, mounting of the locking ring on the male connector element can first be achieved by alignment of the studs of the locking ring and of the male connector element through rotation and longitudinal displacement of the locking ring with respect to the male connector element. This mounting operation can be performed at the factory or onshore.

Then, the connection of two sections with the locking ring can be carried out according to the following stages:

rotation of the locking ring (for example up to a stop) so as to maintain the locked position on the male connector element side (angular sector in contact) and to prepare the connection on the female connector element side, longitudinal displacement of the male connector element with the locking ring for insertion of the female connector element, and locking of the connection by rotation (for example up to a stop) so that the studs of the two connector elements entirely rest on the studs of the locking ring, and optionally securing of the ring by means of a punch and a block.

These stages can be performed offshore, on a boat for example.

For these variant embodiments with a distinct number of studs on either side of the connection, disconnecting two sections with the locking ring can be done according to the following stages:

unlocking the connection by rotation (for example up to a stop) so that the studs of the female connector element are no longer in contact with the studs of the locking ring, while the studs of the male connector element remain in contact with the studs of the locking ring over an angle range, longitudinal displacement of the male connector element with the locking ring so as to remove the female connector element, and rotation of the locking ring (for example up to a stop) so that the studs of the male connector element are no longer in contact with the studs of the locking ring.

The locking ring can thereafter be dismounted from the male connector element by longitudinal displacement of the locking ring with respect to the male connector element.

According to a first variant embodiment of the invention (not shown), auxiliary line element 7 is tightly secured at each end thereof to main tube 6. In other words, riser section 4 comprises, at each end thereof, fastening means allowing an auxiliary line element 7 to be secured to main tube 6. According to this variant embodiment, the fastening means allow longitudinal stresses to be transmitted from main tube 6 to auxiliary line elements 7. Thus, these fastening means allow to distribute the tensile stresses applied onto each riser section among main tube 6 and auxiliary line elements 7.

For example, at the section end provided with female connector element 8, main tube 6 is extended by a shoulder or flange 23 comprising a cylindrical passage in which auxiliary line element 7 can slide. Auxiliary line element 7 comprises a stop, for example a nut or a shoulder, for axially positioning auxiliary line element 7 with respect to flange 23. When auxiliary line element 7 is mounted on main tube 6, the stop of auxiliary line element 7 rests against flange 23, for example against an axial shoulder provided in the cylindrical passage so as to form a rigid link.

At the section end provided with male connector element 9, main tube 6 is extended by a shoulder or flange 24 comprising a cylindrical passage in which auxiliary line element 7 can slide. Auxiliary line element 7 comprises a stop, for example a nut or a shoulder, for axially positioning auxiliary line element 7 with respect to flange 24. When auxiliary line element 7 is mounted on main tube 6, the stop of auxiliary line element 7 rests against flange 24, for example against an axial shoulder provided in the cylindrical passage so as to form a rigid link.

Flanges 23 and 24 have shapes of revolution about the axis of the main tube. Flanges 23 and 24 extend main tube elements 6 by increasing the thickness and the outer section of the tube so as to form shoulders respectively. Preferably, the outer section of flanges 23 and 24 varies progressively along the main tube axis so as to prevent a sudden section variation between main tube 6 and the shoulders, which would weaken the mechanical strength of connector 5. Flanges 23, 24 are arranged on either side of locking ring 11: the distance between flanges 23 and 24 is greater than the height of locking ring 11. The outside diameter of flanges 23, 24 is greater than the diameter of locking ring 11. According to an embodiment of the invention, flanges 23 and 24 form one-piece parts with male connector element 9 and female connector element 8 respectively.

The fastening means consisting of stops allow to block the axial translations of an auxiliary line element 7 in both directions with respect to main tube 6. Thus, the combination of the fastening means allows to completely secure auxiliary line element 7 with respect to main tube 6. Thus, auxiliary line elements 7 contribute, together with main tube element 6, to taking up the longitudinal stresses undergone by riser 1.

The shape and in particular the thickness of flanges 23 and 24 are so determined as to withstand the longitudinal stresses transmitted to auxiliary line elements 7.

Auxiliary line elements 7 are connected end to end by connections. A connection can be made up of a male end piece arranged at one end of auxiliary line element 7 and of a female end piece arranged at the other end of auxiliary line element 7. The male end piece cooperates tightly with the female end piece of another auxiliary line element 7. For example, the male element of the connection is a tubular part that fits into another tubular part of the female end piece. The inner surface of the female end piece is adjusted to the outer surface of the male end piece. Joints are mounted in grooves machined on the inner surface of the female end piece so as to provide a sealed link. The connection allows axial displacement of one of auxiliary line elements 7 with respect to the other, while maintaining the sealed link between the two elements.

Auxiliary line elements 7 can be provided with an adjustment device for length differences between main tube 6 and auxiliary line elements 7 due to manufacturing tolerances.

According to a second variant embodiment of the invention illustrated in FIGS. 2, 3, 8 to 10, auxiliary line element 7 is tightly secured with an interlocking link (no relative motion between the parts) at a single end of main tube 6 and it is connected by a sliding pivot connection to the other end of the main tube. In the present application, a sliding pivot connection designates a link connecting a first solid to a second solid, the first solid can translate with respect to the second solid in the direction of an axis and the first solid can pivot with respect to the second solid about this axis. Thus, auxiliary line element 7 can slide and pivot in the axial direction thereof with respect to main tube 6, auxiliary line element 7 cannot move freely in the radial and tangential directions, i.e. in the directions of a perpendicular plane in FIG. 3.

In other words, riser section 4 comprises, at each end thereof, connection means, schematized in FIG. 3, which allow on the one hand to axially link an auxiliary line element 7 to main tube 6 and, on the other hand, to form the sliding pivot connection between auxiliary line element 7 and main tube 6.

According to an embodiment of the invention illustrated in FIG. 3, the interlocking link between auxiliary line element 7 and main tube element 6 is achieved at female connector element 8, and the sliding pivot connection between auxiliary line element 7 and main tube element 6 is achieved at male connector element 9. Alternatively, the interlocking link between auxiliary line element 7 and main tube element 6 is achieved at male connector element 9, and the sliding pivot connection between auxiliary line element 7 and main tube element 6 is achieved at female connector element 8. Only this first variant is described in the rest of the description, and the second variant can be deduced by symmetry.

At the end of the section provided with female connector element 8, main tube 6 is extended by a shoulder or flange 23 comprising a cylindrical passage in which auxiliary line element 7 can slide. Auxiliary line element 7 comprises a stop, for example a nut or a shoulder for axially positioning element 7 with respect to flange 23. When auxiliary line element 7 is mounted on main tube 6, a stop of element 7 rests against flange 23, for example against the axial shoulder provided in the cylindrical passage so as to form an interlocking link with no relative motion between the parts.

At the end of the section provided with male connector element 9, main tube 6 is extended by a shoulder or flange 24 comprising a cylindrical passage in which auxiliary line element 7 can slide and pivot. Auxiliary line element 7 comprises a clearance adjustment means 15 (or adjustable stop) allowing to limit the relative motion between auxiliary line element 7 and flange 24. Clearance adjustment means 15 forms a stop positioned at an adjustable distance J from flange 24. Thus, during mounting, a clearance J is adjusted using clearance adjustment means 15. Then, when the riser is under tension, the relative motion or the deformation of auxiliary line element 7 or of main tube element 6 is limited by a distance J, beyond a certain tension, the clearance becomes zero and auxiliary line element 7 reaches a stop in flange 24.

The female 8 and male 9 connector elements have shapes of revolution about the axis of the main tube element. According to a possible embodiment of the invention, flanges 23 and 24 can comprise reinforcements positioned perpendicular to some auxiliary lines (choke line and kill line for example). According to the invention, connector elements 8 and 9 extend main tube element 6 by increasing the thickness and the outer section of the tube so as to form shoulders or flanges 23 and 24 respectively. Preferably, the outer section of connector elements 8 and 9 varies progressively along axis 8 so as to prevent a sudden section variation between tube 6 and shoulders 23 and 24 that might weaken the mechanical strength of connector 5. For example, in reference to FIG. 2, flanges 23 and 24 form fillets.

Auxiliary lines 7 undergo axial compressive stresses generated by the internal/external pressure difference that generates an "end effect" applied onto the tube ends (for example, the auxiliary lines can undergo pressures of the order of 1034 bars, i.e. 15,000 psi). Under such pressures, the main tube elements lengthen and the auxiliary line elements shorten until clearance J is zero. When clearance J becomes zero, all the lines lengthen identically. Main tube elements 6 are likely to lengthen because they have to take up, totally or partly, the weight of the riser and the weight of the drilling mud on the one hand, and the tensile stresses imposed on the riser to keep it substantially vertical on the other hand. In general, the main tube elements at the top of the riser, i.e. close to the sea surface, undergo maximum tensile stresses, hence maximum elongation. Auxiliary line elements 7 are likely to shorten under the effect of the difference between the internal pressure and the external pressure due to the fluid they contain. Indeed, the fluid applies a pressure onto the ends of auxiliary line elements 7 by imposing compressive stresses on auxiliary line elements 7. Furthermore, the radial deformation of the tube due to the internal/external pressure difference causes shortening of the tube. In general, elements 4 at the foot of the riser, i.e. close to the sea bed, undergo the maximum internal/external pressure difference, therefore maximum shortening.

As long as clearance J is positive, the length of auxiliary line element 7 and of main tube element 6 positioned at the same height can vary independently of one another. On the other hand, when clearance J becomes zero, i.e. when clearance adjustment means 15 is in contact with flange 24, auxiliary line element 7 and the corresponding main tube element 6 form a hyperstatic assembly: auxiliary line element 7 is secured to main tube element 6 on the one hand at fastening means and, on the other hand, at the stop that is in contact with flange 24. Therefore, main tube element 6 induces tensile stresses in auxiliary line element 7, and vice versa.

Thus, these links allow to distribute the tensile stresses applied onto each riser section among main tube 6 and auxiliary line elements 7. The integration according to the invention via the establishment of clearance J allows to increase the contribution of the main tube and consequently to reduce the axial stresses in the peripheral lines. Reduction of the axial stresses in the peripheral lines by means of this integration is beneficial for the dimensioning of the end pieces and of the thickness of the auxiliary lines.

Advantageously, clearance J is selected as a function of the length of the section; indeed, the deformations of the various lines depend on the length thereof. For a conventional 75 or 90 ft (22.86 m and 27.43 m) riser section, clearance J is set between 0 and 1.5 inch (0 and approximately 38.1 mm). Preferably, clearance J is selected between 0.1 and 1 inch (2.54 and 25.4 mm) for optimal distribution of the stresses in the lines, allowing to generate a decrease in the mass of the riser. Alternatively, clearance J is selected between 0.1 and 0.25 inch (2.54 and 6.35 mm). According to one option, clearance J is selected between 0.25 and 1 inch (6.35 and 25.4 mm). A preferred option providing a good compromise is a clearance of approximately 0.5 inch (12.7 mm) or 1 inch (25.4 mm).

According to the invention, clearance adjustment means 15 is made up of a nut or a threaded element. Clearance J is adjusted (prior to connection of the sections) as a function of the stresses and pressures applied on main tube elements 6 and auxiliary line elements 7. The presence of a clearance is beneficial for the dimensioning of the end pieces of the peripheral lines and of the thickness of the auxiliary lines.

Figure 8:
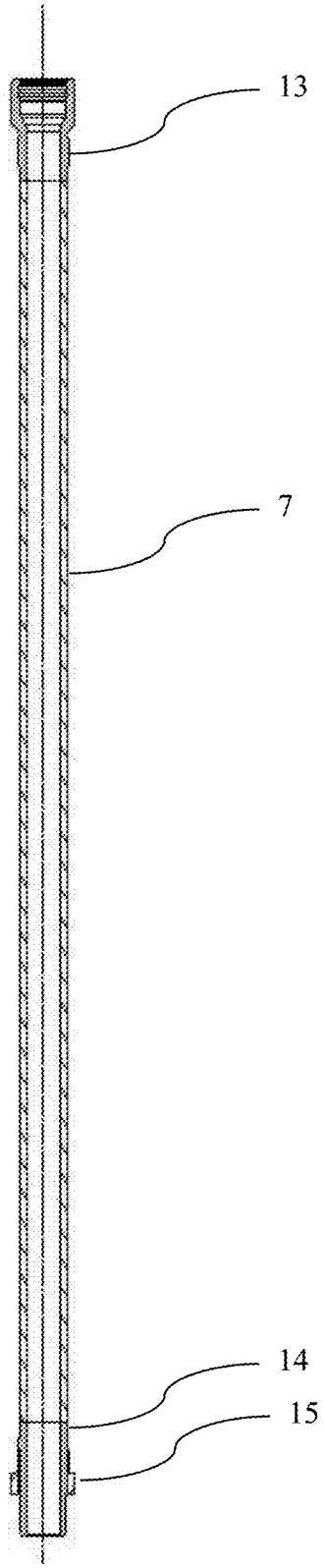
FIGS. 8 to 10 show three variant embodiments according to the invention of an auxiliary line.
Figure 9:
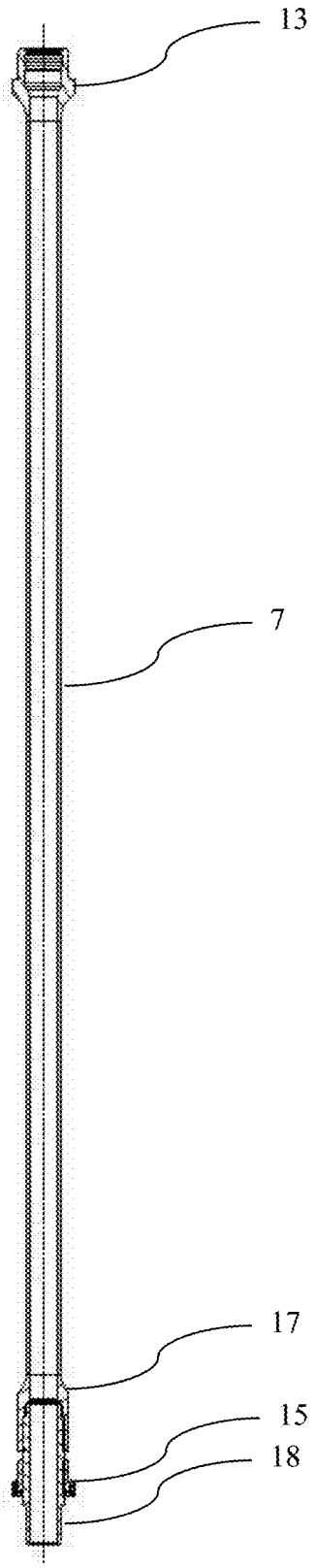
Figure 10:
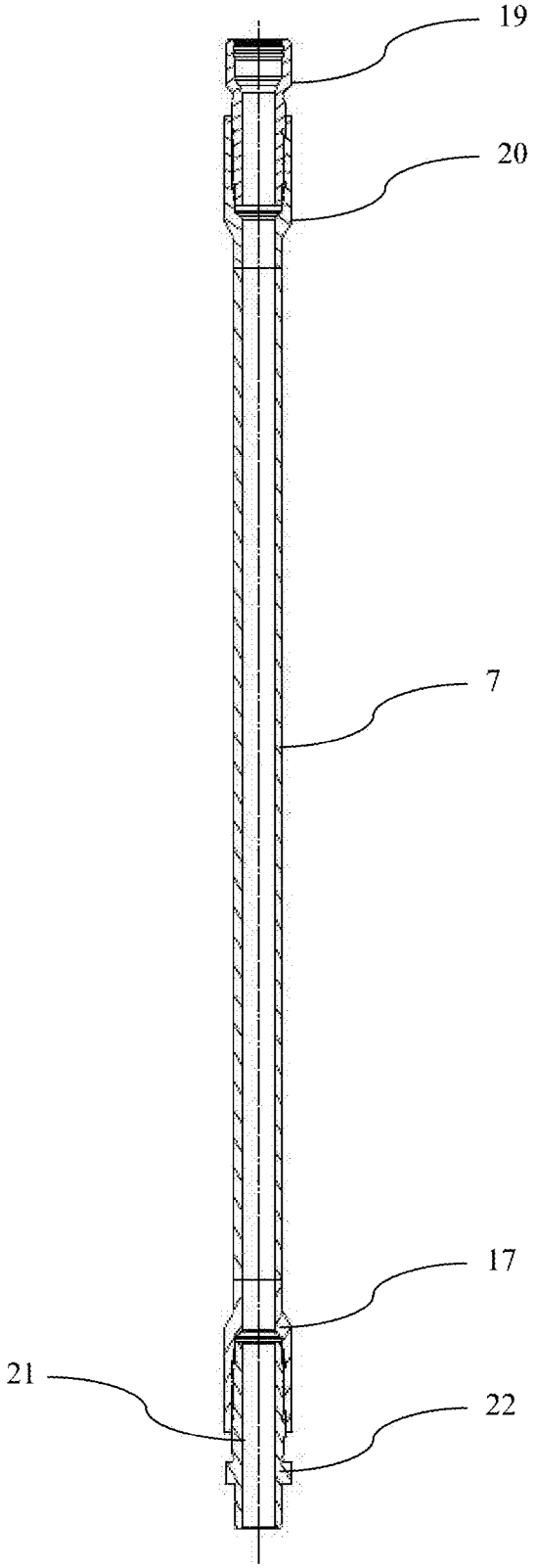

FIGS. 8 to 10 illustrate three variant embodiments of auxiliary line element 7 equipped with clearance adjustment means.

According to a first variant embodiment of the clearance adjustment means illustrated in FIGS. 2, 3, 6 and 8, auxiliary line elements 7 are connected end to end by connections. A connection is made up of a male end piece 14 arranged at one end of element 7 and of a female end piece 13 arranged at the other end of element 7. A male end piece 14 cooperates tightly with female end piece 13 of another element 7. For example, male end piece 14 of the connection is a tubular part that fits into another tubular part 13. The inner surface of female end piece 13 is adjusted to the outer surface of male end piece 14. Joints are mounted in grooves machined on the inner surface of female end piece 13 so as to provide a sealed link. The connection allows axial displacement of one of elements 7 with respect to the other, while maintaining the sealed link between the two elements. The male 14 and female 13 end pieces are fastened for example through welding or crimping to a central tube of substantially same length as main tube element 6 to which auxiliary line element 7 is secured. For this variant embodiment of the invention, the clearance adjustment means consists of a nut 15 positioned on male end piece 14, on a threaded portion that is not intended to be inserted in a female end piece 13.

According to a second variant embodiment of the clearance adjustment means illustrated in FIG. 9, auxiliary line elements 7 are connected end to end by means of connections. A connection consists of a male pin 18 inserted in a receptacle 17 at one end of element 7 and of a female end piece 13 arranged at the other end of element 7. Male pin 18 tightly cooperates with female end piece 13 of another element 7. For example, male pin 18 of the connection is a tubular part that fits into another tubular part 13. The inner surface of female end piece 13 is adjusted to the outer surface of male pin 18. Joints are mounted in grooves machined on the inner surface of female end piece 13 so as to provide a sealed link. The connection allows axial displacement of one of elements 7 with respect to the other, while maintaining the sealed link between the two elements. Female end piece 13 is for example fastened through welding or crimping to a central tube of substantially same length as main tube element 6 to which auxiliary line element 7 is secured. Receptacle 17 is for example fastened through welding or crimping to the central tube. Male pin 18 is fastened to receptacle 17 notably through screwing. Thus, male pin 18 is a wearing part that can be changed during riser maintenance. For this variant embodiment of the invention, the clearance adjustment means consists of a nut 15 positioned on male pin 18 on a threaded portion that is not intended to be inserted in a female end piece 13.

According to a third variant embodiment of the clearance adjustment means illustrated in FIG. 10, auxiliary line elements 7 are connected end to end by connections. A connection consists of a male pin 21 inserted in a receptacle 17 at one end of element 7 and of a female pin 19 inserted in a receptacle 20 arranged at the other end of element 7. Male pin 21 tightly cooperates with female pin 19 of another element 7. For example, male pin 21 of the connection is a tubular part that fits into another tubular part 19. The inner surface of female pin 19 is adjusted to the outer surface of male pin 21. Joints are mounted in grooves machined on the inner surface of female pin 19 so as to provide a sealed link. The connection allows axial displacement of one of elements 7 with respect to the other, while maintaining the sealed link between the two elements. Receptacle 20 is for example fastened through welding or crimping to a central tube of substantially same length as main tube element 6 to which auxiliary line element 7 is secured. Female pin 19 is fastened to receptacle 20 notably through screwing. Receptacle 17 is for example fastened through welding or crimping to the central tube. Male pin 21 is fastened to receptacle 17 notably through screwing. Thus, the male 21 and female 19 pins are wearing parts that can be changed upon riser maintenance. For this embodiment of the invention, the clearance adjustment means consists of male pin 21 that is threaded in the receptacle and has a shoulder 22 providing the stop.

According to an embodiment of the invention, auxiliary line elements 7 are hooped tubes with reinforcement wires such as glass, carbon or aramid fibers, coated with a polymer matrix. Thus, the resistance and the weight of the auxiliary lines are optimized. Indeed, the present invention is particularly well suited for hooped auxiliary line elements that afford the advantage of reducing the steel thickness and therefore the weight of the riser. The drawback of hooping, which involves lower flexural rigidity, is compensated by the clearance that allows buckling of the auxiliary lines to be limited. Alternatively, the main tube and auxiliary line elements can be made of aluminium alloy or titanium alloy.

The device according to the invention provides an interesting solution for rapidly and simply mounting a riser whose tensile stresses are distributed among the auxiliary line elements and the main tube. Indeed, although auxiliary line elements 7 and main tube elements 6 are mounted so as to jointly withstand the tensile stresses undergone by the riser, connection of a riser section 4 to another riser section 4 is achieved in a single operation through rotation of locking ring 11. This connection allows to communicate and to seal main tube element 6 of a section 4 with that of the other section 4 and, simultaneously, to communicate and to seal auxiliary line elements 7 of one of sections 4 with those of the other section 4.

The compact connector according to the invention allows to minimize the bending stresses in flanges 23 and 24, and thus to reduce the dimensions of flanges 23 and 24, and to decrease the weight of the connectors.

Besides, the fact that ring 11 is positioned between main tube element 6 and auxiliary tube elements 7 allows the strength of the connector to be increased. Indeed, ring 11 holds flanges 23 and 24 in place and prevents bending thereof. Furthermore, this positioning allows to reduce connection interference problems of auxiliary lines 7 because the bending moments generated by the off-center axial stresses have opposite signs. Moreover, in locked position, the studs of ring 11 are engaged with the studs of female connector element 8 that are positioned on the massive part of female connector element 8.

Furthermore, the combination of locking with a locking ring and of the existence of a clearance in the connection of the auxiliary line elements allows the weight of the riser to be optimized.

Variant Embodiment

According to a second embodiment of the invention, the riser section also comprises a locking collar for connection of two consecutive sections. This locking collar is referred to as external or peripheral because it cooperates with the periphery (the outermost part: with the largest diameter) of the flanges of the male and female connector elements so as to assemble them. The auxiliary lines thus are within the locking collar. Thus, two consecutive sections are assembled by two elements: a locking ring and a peripheral locking collar, in order to transmit axial stresses.

Figure 6:
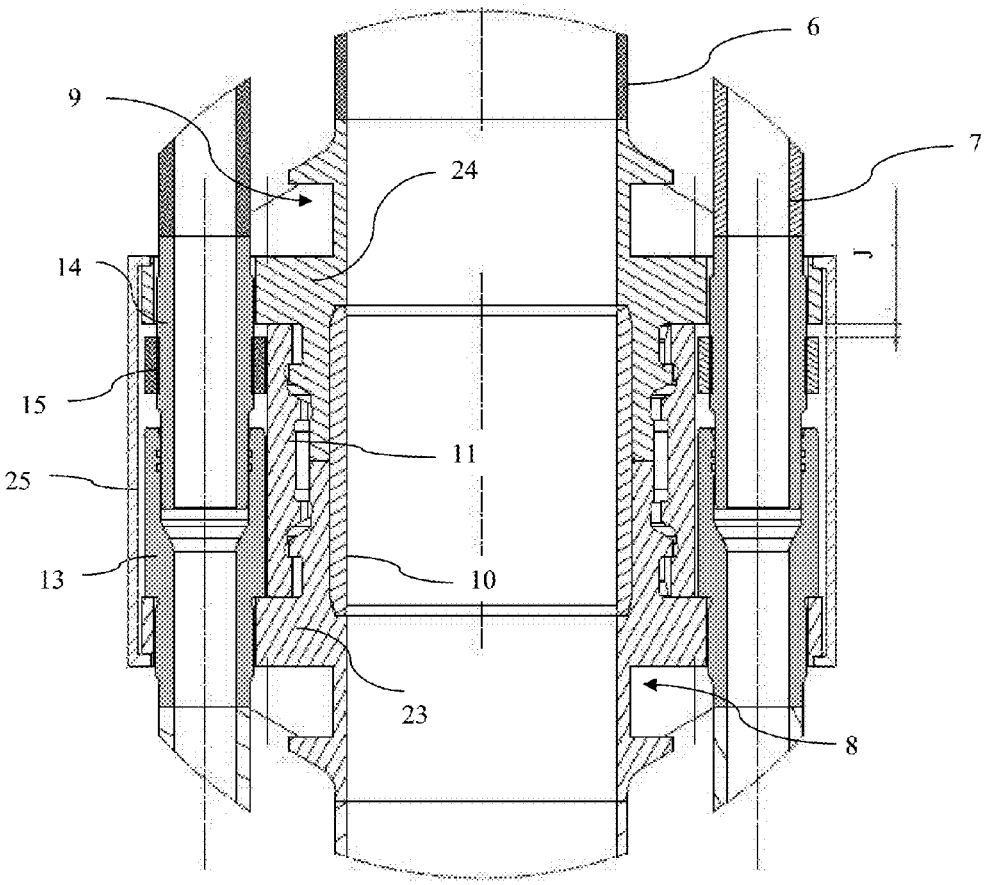
FIG. 6 illustrates the connection of two riser sections according to a second embodiment of the invention.

FIG. 6 illustrates the second embodiment of the invention with a clearance adjustment means. The elements identical to the first embodiment are designated by the same reference signs. As in the first embodiment illustrated notably by FIG. 3, a male connector element 9 is fitted in a female connector element 8. A portion of male connector element 9 penetrates inside female connector element 8. This fitting is limited by an axial stop: the end of male connector element 9 comes to rest against the axial shoulder provided on the inner surface of female connector element 8: the axial shoulder provided on the outer surface of male connector element 9 comes to rest against the axial shoulder provided on the inner surface of female connector element 8. As illustrated in FIG. 6, male connector element 9 can comprise a sleeve 10 fastened in the male connector element. Sleeve 10 fulfils a centering and sealing function with respect to the male 9 and female 8 connector elements. Fastening of sleeve 10 can be achieved by welding, by threading, by glueing, by hooping or by any other similar means. Instead of sleeve 10, variant embodiments (not shown) can be considered, such as an extension of main tube element 6.

Connector 5 comprises a locking ring 11 that is positioned between main tube element 6 and auxiliary line element 7. When male connector element 9 is fitted in a female connector element 8, a part of ring 11 comes into contact with the outer surface of female connector element 8 in such a way that a series of studs 12 provided on the inner surface of ring 11 cooperates with a series of studs provided on the outer face of female connector element 8. Locking and unlocking of connector 5 is achieved through rotation of ring 11 (bayonet type locking). Locking ring 11 is mounted on male connector element 9. According to the embodiment illustrated in FIG. 3, locking ring 11 comprises on the inner face thereof another series of studs 16 cooperating with a series of studs positioned on the outer face of male connector element 9. Thus, locking ring 11 is fastened to the male connector element when riser sections are connected. In an unlocked situation, ring 11 is secured to male connector element 9 by pins (not shown in FIG. 3). Furthermore, this embodiment of locking ring 11 allows to have a connector that can be entirely dismounted so as to facilitate inspection and maintenance thereof. This embodiment also allows to have a ring 11 and male 9 and female 8 connector elements that are nearly symmetrical, which facilitates their manufacture.

In reference to FIG. 6, ring 11 is mounted on the outer surface of male connector element 9. It is secured by the series of studs of the ring and the male 9 and female 8 connector elements. Thus, the axial stresses are transmitted from male connector element 9 to female connector element 8 via the studs without going through sleeve 10.

For this second embodiment of the invention, connector 5 also comprises a locking collar 25 that is positioned on the outer (peripheral) surface of flanges 23 and 24. Auxiliary lines 7 thus are within locking collar 25. The diameter of locking collar 25 is larger than the diameter of locking ring 11. Collar 25 can be machined in a tube portion. Collar 25 is provided at each end thereof with stops that respectively cooperate with flanges 23 and 24 so as to block the translational motion, along the axis of the main tube, of flanges 23 and 24. Locking collar 25 is mounted mobile in rotation on flange 24 while being blocked in translation in the direction of the main tube axis. In reference to FIG. 6, collar 25 comprises at least a portion of cylindrical inner surface of radius S and the outer peripheral surface of flange 23 is cylindrical with a radius slightly smaller than S. Collar 25 is mounted on flange 24 by centering the inner cylindrical surface of the collar on the outer cylindrical surface of flange 24. Moreover, collar 25 comprises a neck forming a radial recess of the cylindrical inner surface of collar 25. Collar 25 rests on an axial shoulder provided on flange 24. The inner surface of collar 25 comprises studs. Flange 23 of the female connector element also comprises studs arranged on the outer peripheral surface thereof. When male connector element 9 is fitted in female connector element 8, part of collar 25 covers flange 23 so that the studs of collar 25 can cooperate with the studs of flange 23 of female connector element 8.

Assembly by means of a peripheral collar 25 provides great stiffness of the locking system, which allows to limit deformations (bending) of the flanges. Furthermore, double locking provides the connector with the capacity to transmit significant stresses. Moreover, this design with double bayonet connection (male connector element side and female connector element side) allows the connector to be entirely dismountable for inspection and maintenance, and it also enables near-symmetry of the flanges, which facilitates manufacture thereof.

As illustrated in FIG. 6, locking collar 25 additionally comprises a second series of studs on the inner surface thereof and the peripheral outer surface of flange 24 of male connector element 9 also comprises studs suited to cooperate with the studs of locking collar 25.

Figure 7:
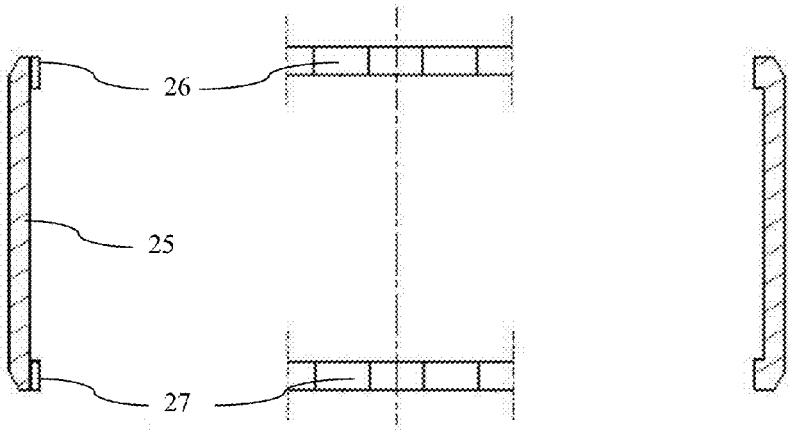
FIG. 7 illustrates a locking collar for the second embodiment of the invention.

FIG. 7 shows a peripheral locking collar 25. Locking collar 25 comprises a first series of studs 27 suited to cooperate with studs of a flange 23 of a female connector element 8 and a second series of studs suited to cooperate with studs of a flange 24 of a male connector element 9.

Locking and unlocking of connector 5 is achieved through rotation of collar 25 and rotation of locking ring 11 (bayonet type locking). Collar 25 and ring 11 are provided with operating means, for example an operating bar that can be dismountable. The operating means allow collar 25 to be pivoted around flanges 23 and 24 along the main tube axis and, independently or simultaneously, ring 11 to be pivoted along the main tube axis. To achieve simultaneous rotation of the ring and the collar, collar 25 can be secured to ring 11 by a rigid link (for example by means of rods or of a hollowed plate preventing interference with the auxiliary lines upon rotation of the locking ring/collar assembly).

Rotation stop means and means for holding the ring/collar system in locked and unlocked position can be provided, for example blocks, pins, punches or screws arranged on flange 24 and collar 25.

The longitudinal stresses, i.e. the tensile stresses oriented along the axis of the main tube, are transmitted from a section 4 to the adjacent section 4 on the one hand through the agency of the bayonet type connection between collar 25 and flanges 23 and 24 and, on the other hand, through the agency of the bayonet type connection between ring 11 and the male 9 and female 8 connector elements.

The layout of the connector according to the invention allows to transmit nearly all of the stresses in the main tube by means of inner ring 11, while the stresses in the auxiliary lines are transmitted partly via inner ring 11 and partly via outer collar 25. Indeed, for this embodiment, the stresses are transmitted from flange 24 of male connector element 9 to flange 23 of female connector element 8 via the studs of ring 11 and collar 25 without going through sleeve 10. The distribution of the stresses among ring 11 and collar 25 depends on the stiffness and on the stresses in the lines.

The height of collar 25 can be determined in such a way that the distance between the lower face of the circular neck and the upper face of studs 26, 27 is equal to the distance between flanges 23 and 24 increased by a clearance at least equal to that of inner ring 11. Furthermore, a space is necessary between the two flanges 23 and 24 for housing connections 13, 14 of auxiliary lines 7 and clearance adjustment means 15.

Openings can be provided in the parts of collar 25 positioned, vertically and circumferentially, between the studs. These openings allow, on the one hand, to reduce the weight of the part, and also and above all to see the ends of auxiliary line elements 7 as they are being connected and thus to prevent damage that would result from a blind approach.

According to the invention, auxiliary line element 7 is tightly secured with an interlocking link (no relative motion between the parts) at a single end of main tube 6 and it is connected by a sliding pivot connection to the other end of the main tube. FIG. 6 shows the second embodiment with clearance adjustment means. However, the second embodiment can be implemented by securing auxiliary line element 7 to both ends of main tube element 6. Only this first variant embodiment of the second embodiment with a pivot connection is described.

It is reminded that a sliding pivot connection designates a link connecting a first solid to a second solid, the first solid can translate with respect to the second solid in the direction of an axis and the first solid can pivot with respect to the second solid about this axis. Thus, auxiliary line element 7 can slide and pivot in the axial direction thereof with respect to main tube 6, auxiliary line element 7 cannot move freely in the radial and tangential directions, i.e. in the directions of a perpendicular plane in FIG. 3.

In other words, riser section 4 comprises, at each end thereof, connection means, schematized in FIG. 6, which allow on the one hand to axially link an auxiliary line element 7 to main tube 6 and, on the other hand, to form the sliding pivot connection between auxiliary line element 7 and main tube 6.

According to an embodiment of the invention illustrated in FIG. 6, the interlocking link between auxiliary line element 7 and main tube element 6 is achieved at female connector element 8, and the sliding pivot connection between auxiliary line element 7 and main tube element 6 is achieved at male connector element 9. Alternatively, the interlocking link between auxiliary line element 7 and main tube element 6 is achieved at male connector element 9, and the sliding pivot connection between auxiliary line element 7 and main tube element 6 is achieved at female connector element 8. Only this first variant is described in the rest of the description, and the second variant can be deduced by symmetry.

At the end of the section provided with female connector element 8, main tube 6 is extended by a shoulder or flange 23 comprising a cylindrical passage in which auxiliary line element 7 can slide. Auxiliary line element 7 comprises a stop, for example a nut or a shoulder for axially positioning element 7 with respect to flange 23. When auxiliary line element 7 is mounted on main tube 6, a stop of element 7 rests against flange 23, for example against the axial shoulder provided in the cylindrical passage so as to form an interlocking link with no relative motion between the parts.

At the end of the section provided with male connector element 9, main tube 6 is extended by a shoulder or flange 24 comprising a cylindrical passage in which auxiliary line element 7 can slide and pivot. Auxiliary line element 7 comprises a clearance adjustment means 15 (or adjustable stop) allowing to limit the relative motion between auxiliary line element 7 and flange 24. Clearance adjustment means 15 forms a stop positioned at an adjustable distance J from flange 24. Thus, during mounting, a clearance J is adjusted using clearance adjustment means 15 or 18. Then, when the riser is under tension, the relative motion or the deformation of auxiliary line element 7 or of main tube element 6 is limited by a distance J, beyond a certain tension, the clearance becomes zero and auxiliary line element 7 reaches a stop in flange 24.

According to the invention, clearance adjustment means 15 consists of a nut or a threaded element. Clearance J is adjusted (prior to connection of the sections) as a function of the stresses and pressures applied on main tube elements 6 and auxiliary line elements 7. The presence of a clearance is beneficial for the dimensioning of the end pieces of the peripheral lines.

According to the variant embodiment illustrated in FIG. 6 (corresponding to the embodiment of FIG. 8), auxiliary line elements 7 are connected end to end by means of connections. A connection is made up of a male end piece 14 arranged at one end of element 7 and of a female end piece 13 arranged at the other end of element 7. A male end piece 14 cooperates tightly with female end piece 13 of another element 7. For example, male end piece 14 of the connection is a tubular part that fits into another tubular part 13. The inner surface of female end piece 13 is adjusted to the outer surface of male end piece 14. Joints are mounted in grooves machined on the inner surface of female end piece 13 so as to provide a sealed link. The connection allows axial displacement of one of elements 7 with respect to the other, while maintaining the sealed link between the two elements. The male 14 and female 13 end pieces are fastened for example through welding or crimping to a central tube of substantially same length as main tube element 6 to which auxiliary line element 7 is secured. For this variant embodiment of the invention, the clearance adjustment means consists of a nut 15 positioned on male end piece 14, on a threaded portion that is not intended to be inserted in a female end piece 13.

Alternatively, the connections of the auxiliary line elements are identical to those of FIGS. 9 and 10.

Application Example

An application example is presented in order to describe the stress distribution and the mass gain in a riser according to the invention.

For this example according to FIG. 3, the conditions are as follows:

Water depth: 12,500 ft (3810 m)

Maximum mud density: 14.5 ppg (1.74)

Auxiliary lines operating pressure: 15,000 psi (1034 bar)

Maximum working load of the connector: 4,000 kips (1814 t)

Length of the riser sections: 75 ft (22.86 m)

Tapered riser architecture: 7 sections of variable thickness for the main tube.

Table 1 gives the stress distribution in the main tube and in the auxiliary lines: kill line, choke line, booster line, hydraulic line, as a function of clearance J in inches.

TABLE 1

Distribution of the stresses in the riser

| | Clearance J (inches) | | | | | | |
|---|---|---|---|---|---|---|---|
| | 0 | 0.25 | 0.5 | 1 | 1.5 | 2 | 2.5 |
| Main tube | 45% | 50% | 55% | 67% | 82% | 97% | 100% |
| Kill line | 20% | 18% | 16% | 12% | 7% | 1% | 0% |
| Choke line | 20% | 18% | 16% | 12% | 7% | 1% | 0% |
| Booster line | 7% | 6% | 6% | 4% | 1% | 0% | 0% |
| Hydraulic line | 4% | 4% | 3% | 2% | 1% | 0% | 0% |

It can be seen that the distribution varies in the sense of a greater contribution of the main tube when the clearance increases. Between a zero clearance and a 1-inch (25.4 mm) clearance, the stress distribution among the main tube and the peripheral lines shifts from 45%-55% to 67%-33% respectively. Above 2 inches (50.8 mm), one considers that there is no more stress distribution among the various lines, only the main tube takes part in the taking up of the stresses, which is not desirable.

Figure 11:
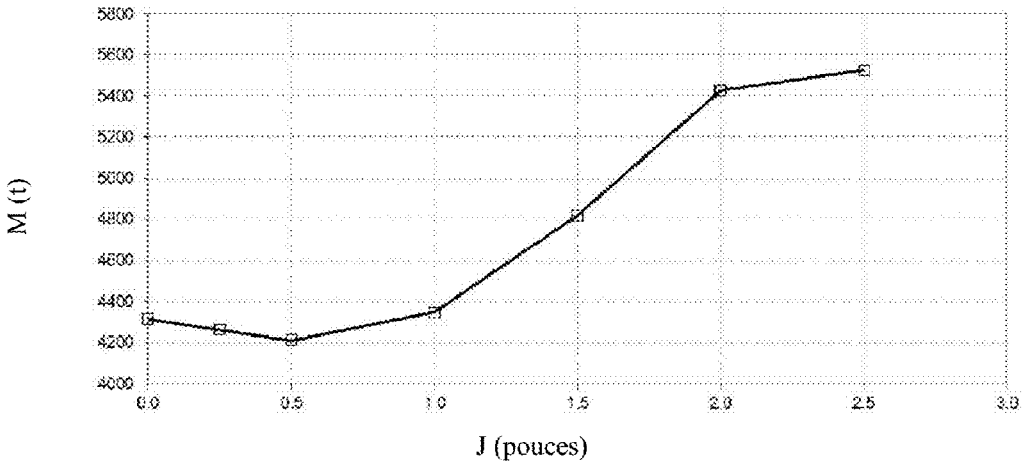
FIG. 11 is a curve showing the mass of the riser as a function of the clearance for an example according to the invention.

FIG. 11 shows the mass M in tons of the riser as a function of clearance J in inches for this example. For this curve, the thicknesses of the main tube and of the auxiliary lines have been optimized so as to meet the aforementioned conditions. It can be observed that the mass is minimal between 0 and 1 inch (25.4 mm) and that a mass optimum is obtained with a clearance of 0.5 inch (12.7 mm). Above 1.25 inch (31.75 mm), the mass of the riser increases significantly, which leads to an increase in the cost of the riser.

Considering the stress distribution and the mass variation as a function of the clearance, the clearance can be set between 0 and 1.25 inch (0 and 31.75 mm) for this example according to the invention. Preferably, the clearance can be set between 0.1 and 1 inch (2.54 mm and 25.4 mm). Optimally, the clearance can be 0.5 inch (12.7 mm).

The invention claimed is:

1. A riser section comprising a main tube element extended by a male connector element and by a female connector element, wherein a locking ring is mounted on and dismountable from the male connector element, and wherein the riser section additionally comprises at least one auxiliary line element, the male and female connector elements extending the main tube element by increasing the section and the thickness of the main tube element so as to form flanges for passage of the auxiliary line element, characterized in that the locking ring is arranged between the main tube element and the auxiliary line element, the inner surface of the locking ring comprises a first series of studs, the outer surface of the female connector element comprises a second series of studs, the first series of studs is suited to cooperate with the second series of studs on an adjacent riser section to form a bayonet assembly, the male connector element comprises a third series of studs on the outer face thereof and the inner surface of the locking ring comprises a fourth series of studs suited to cooperate with the third series of studs, the third and fourth series of studs cooperate to form a bayonet assembly, in order to render the locking ring mountable on and dismountable from the male connector element, wherein the auxiliary line element is secured to a flange of the flanges of the male and female connector elements and the auxiliary line element is connected by a sliding pivot connection to the other flange of the flanges of the male and female connector elements, the sliding pivot connection allowing a relative translational motion between the main tube element and the auxiliary line element over a distance limited by a clearance adjustment means arranged on the auxiliary line element.

2. A section as claimed in claim 1, wherein at least one stud of the third and fourth series of studs protrudes over an angle range distinct from the angle range of the studs of the first and second series of studs.

3. A section as claimed in claim 2, wherein each row of the first and second series of studs comprises a number of studs distinct from the number of studs of each row of the third and fourth series of studs.

4. A section as claimed in claim 3, wherein the first and second series of studs comprise at least one row of four studs, and the third and fourth series of studs comprise at least one row of three studs.

5. A section as claimed in claim 4, wherein the first and second series of studs comprise two rows of studs, and the third and fourth series of studs comprise one row of studs.

6. A section as claimed in claim 1, wherein the first and second series of studs comprise a number of rows distinct from the number of rows of the third and fourth series of studs.

7. A section as claimed in claim 1, wherein each series of studs comprises at least two rows of at least four studs.

8. A section as claimed in claim 1, wherein a sleeve is secured within the male connector element, the sleeve being suited to cooperate with female connector element so as to form a sealed link.

9. A section as claimed in claim 1, wherein the riser section comprises a locking collar cooperating with the peripheral surfaces of the flanges for assembling the flanges.

10. A section as claimed in claim 9, wherein the inner face of the locking collar is provided with a first series of studs and the peripheral surface of flange of the female connector element comprises a second series of studs.

11. A section as claimed in claim 10, wherein the inner face of the locking collar is provided with a third series of studs and the peripheral surface of flange of the male connector element comprises a fourth series of studs suited to cooperate with the third series of studs.

12. A section as claimed in claim 1, wherein the auxiliary line element is a hooped steel tube with reinforcement wires coated with a polymer matrix.

13. A section as claimed in claim 1, wherein the auxiliary line element is secured to the two flanges of the male and female connector elements.

14. A section as claimed in claim 1, wherein the clearance adjustment means comprises a nut or a threaded part.

15. A section as claimed in claim 14, wherein an end of the auxiliary line element is extended by a female end piece and another end of the auxiliary line element is extended by a male end piece provided with a nut.

16. A section as claimed in claim 14, wherein an end of the auxiliary line element is extended by a female end piece and another end of the auxiliary line element is extended by a receptacle in which a male pin provided with a stop is inserted.

17. A section as claimed in claim 14, wherein an end of the auxiliary line element is extended by a receptacle in which a female pin is inserted and another end of the auxiliary line element is extended by a receptacle in which a male threaded pin is screwed, the male threaded pin comprising a shoulder.

18. A section as claimed in claim 1, wherein the distance limited by the clearance adjustment means ranges between 0 mm and 31.75 mm.

19. A riser comprising at least two riser sections as claimed in claim 1, for which connection between two consecutive sections is achieved by means of the male and female connector elements and of the locking ring.

20. A riser comprising at least two sections as claimed in claim 1, for which connection between two consecutive sections is achieved by means of the male and female connector elements and of the locking ring, and wherein the distance of the relative translational motion of the sliding pivot connection is adjusted so as to be positive upon connection of at least two sections of the riser and to be zero while using the riser.

21. A method of carrying out an offshore drilling operation, the method comprising assembling the at least two riser sections of the riser of claim 19.

22. A riser section comprising:

a main tube element comprising a male connector element and a female connector element on opposite ends of the main tube element, the male connector element and the female connector element comprising flanges;

at least one auxiliary line element secured with an interlock link to a flange of the flanges and connected by a sliding pivot connection to another flange of the flanges, the sliding pivot connection allowing a relative translational motion between the main tube element and the at least one auxiliary line element;

an adjustable stop provided on the at least one auxiliary line element, the adjustable stop limiting the relative translational motion; and a locking ring arranged between the main tube element and the at least one auxiliary line element, an inner surface of the locking ring comprising a first series of studs, an outer surface of the female connector element comprising a second series of studs, the first series of studs being suited to cooperate with the second series of studs on an adjacent riser section to form a bayonet assembly, an outer surface of the male connector element comprising a third series of studs, the inner surface of the locking ring further comprising a fourth series of studs suited to cooperate with the third series of studs to form a bayonet assembly.

* * * * *